United States Patent [19]

Triolo et al.

[11] Patent Number: 4,834,623

[45] Date of Patent: May 30, 1989

[54] ELECTRIC FUEL PUMP

[75] Inventors: Innocenzo Triolo; Lanfranco Toschi, both of Casalecchio Di Reno; Marcello Lorenzoni, Bologna, all of Italy

[73] Assignee: Weber S.r.l., Turin, Italy

[21] Appl. No.: 138,311

[22] Filed: Dec. 28, 1987

[30] Foreign Application Priority Data

Dec. 30, 1986 [IT] Italy ..... 67981 A/86

[51] Int. Cl.[4] ..... F04B 17/02

[52] U.S. Cl. ..... 417/366; 417/311; 417/410

[58] Field of Search ..... 417/307, 311, 319, 365, 417/366, 369, 410, 423 B, 423 P, 423 T; 310/90, 191

[56] References Cited

U.S. PATENT DOCUMENTS

| | | | |
|---|---|---|---|
| 3,969,044 | 7/1976 | Fussner et al. | 417/410 |
| 4,396,358 | 8/1983 | de Concini | 417/366 X |
| 4,447,192 | 5/1984 | Tuckey | 417/366 X |
| 4,456,436 | 6/1984 | Schillinger et al. | 417/366 |
| 4,573,882 | 3/1986 | Watanabe et al. | 417/423 P X |
| 4,624,630 | 11/1986 | Hirahara et al. | 310/191 X |

FOREIGN PATENT DOCUMENTS

| | | | |
|---|---|---|---|
| 3130288 | 2/1983 | Fed. Rep. of Germany | 417/410 |
| 2041448 | 9/1980 | United Kingdom | 417/410 |

*Primary Examiner*—Carlton R. Croyle
*Assistant Examiner*—Eugene L. Szczecina, Jr.
*Attorney, Agent, or Firm*—Albert L. Jeffers; Anthony Niewyk

[57] ABSTRACT

The pump comprises a casing in which is disposed a stator armature of an electric motor, a rotatable shaft to which is fixed a rotor winding and which is torsionally connected to an impeller rotor of the pump and a pair of covers which close the ends of the said casing and define between them a chamber within the casing for the fuel; a first end of the rotatable shaft is supported by a first seat formed within a cavity of a sleeve of a first cover projecting axially from the inner surface of the cover itself and the second end of this shaft is supported by a second seat formed in the second cover.

10 Claims, 3 Drawing Sheets

ELECTRIC FUEL PUMP

BACKGROUND OF THE INVENTION

The present invention relates to an electric fuel pump comprising a casing in which is disposed a stator armature of an electric motor, a rotatable shaft to which is fixed a rotor winding of the motor and which is torsionally connected to a pump impeller rotor, and a pair of covers for closing the ends of the casing and defining between them a chamber within the casing for the fuel.

Pumps of this type are known in which to the said first cover is rigidly connected a fixed shaft which constitutes the support for the rotor winding and for the other parts of the pump which are connected to this latter. In this constructional arrangement the rotor winding is formed on a tubular element which is traversed by the fixed shaft and which is provided with a pair of end bearings supported on the outer surface of the shaft itself. On a first end of the rotor winding, which faces the impeller rotor, are formed teeth which couple with corresponding teeth of the impeller rotor itself for the purpose of driving it to rotate.

In order to fix the rotor winding in the correct axial position with respect to the impeller rotor there is normally used a resilient ring which is inserted in a corresponding annular cavity of the fixed shaft and which constitutes a shoulder for the second end of the rotor winding.

The pump impeller rotor, which is also directly rotatable on the fixed shaft, is housed within a casing which is formed by the first cover, a plate fixed to this and a spacer of annular form interposed between the first and the second; the impeller rotor is therefore rotatable between a pair of substantially parallel walls of the cover and the plate, and normally has a plurality of radial cavities in which move rollers cooperating with suitable guide surfaces formed on the interior of the said spacer: with this constructional arrangement there is formed a volumetric pump which is able to cause fluid to circulate from a suction hole formed in the first cover to a discharge hole formed within the plate and axially along the chamber which is defined within the casing and by the two pump covers.

Pumps of the type briefly described have various disadvantages.

First of all, the first-defined lateral surfaces of the first cover and the plate which define the cavity in which the pump impeller rotor is rotatable and the corresponding lateral surfaces of the impeller rotor itself can be imperfectly parallel and therefore give rise to non-uniform clearances which cause losses by escape of the fuel and therefore are sources of a considerable reduction in the volumetric efficiency of the pump itself. This disadvantage is due to the fact that the fixed shaft, which is connected to the first cover, can be imperfectly orthogonal to the inner surface of the cover itself and therefore give rise to the said errors in parallelism between the lateral surfaces of the impeller rotor and the interior of the cover and the plate, the impeller rotor itself being directly rotatable on the fixed shaft. This disadvantage can therefore easily occur since the connection of the fixed shaft to the first cover is achieved by fitting the end of the shaft itself into a corresponding hole of the cover using a press: it is therefore evident that during this operation errors of orthogonality between the axis of the shaft and the cover, or small deformations of the shaft itself, can easily occur. The same constructional and assembly errors of the unit constituted by the first cover and the fixed shaft can be the source of another disadvantage constituted by the inaccurate centring of the rotor winding with respect to the stator armature or in the production of abnormal stresses between the bearings of the first and the fixed shaft.

Moreover, in pumps of the type described there are always not inconsiderable axial clearances between the rotor winding and the pump impeller rotor which tend to increase in use: this disadvantage arises from the manner in which the rotor winding is axially fixed with respect to the fixed shaft by means of the said resilient end ring, which constitutes a shoulder for the winding itself.

Moreover, the said axial clearances can depend, in an important measure, on the dimensional tolerances of the various rotary members which are supported by the fixed shaft and which are therefore axially fixed by the said resilient ring: it is evident that for the purpose of maintaining this axial clearance within reasonable limits the various parts mentioned above must be worked with very strict tolerances.

Further, the structure of the pump of the type described is very complex because of the numerous parts of which it is constituted: in particular the rotor winding is provided with an internal tubular element for supporting it and for housing the bearings provided for supporting the winding itself in its rotation with respect to the fixed shaft.

The operations necessary for balancing the rotor winding before its assembly on the pump are very difficult since, in order to support it for rotation during these operations it is necessary to introduce a mandrel into the interior of the tubular element and the first-mentioned bearings, the mandrel having a suitable form and dimensions and the ends of which can be engaged on suitable seats of the balancing machine.

Finally, the various operations which precede the assembly of the pump, such as those connected with the storing and movement of the various parts and the various units of the pump, are rather difficult because of the considerable size of the assembly constituted by the first cover and the fixed shaft connected to it: this assembly thus has an axial length depending on that of the fixed shaft which is substantially equal to that of the finished pump, and a diameter corresponding to that of the first cover which is substantially equal to the diameter of the casing of the pump.

SUMMARY OF THE INVENTION

The object of the present invention is that of providing an electric fuel pump of the type first indicated, which will be free from the disadvantages which have been described.

This object and other further advantages are obtained by an electric fuel pump comprising a casing in which a stator armature of an electric motor is disposed, a rotatable spindle to which a rotor winding of the said electric motor is fixed, which is torsionally connected to a pump impeller rotor, and a pair of covers for closing the ends of the said casing and defining between them a fuel chamber within the casing, the said impeller rotor bearing substantially against the inner surface of a first of these covers and being operable to cause the fuel to flow axially within the interior of the said chamber, characterised by the fact that a first end of the said rotatable shaft is supported by a first seat formed within the interior of a cavity of a sleeve fixed to the said first cover and projecting axially from the said inner surface of the cover itself and the second end of the said fixed shaft is supported by a second seat formed in the said second cover.

BRIEF DESCRIPTION OF THE DRAWINGS

For a better understanding of the present invention a more detailed description will now be given by way of example with reference to the attached drawings, in which.

DETAILED DESCRIPTION OF THE INVENTION

Figure 1:
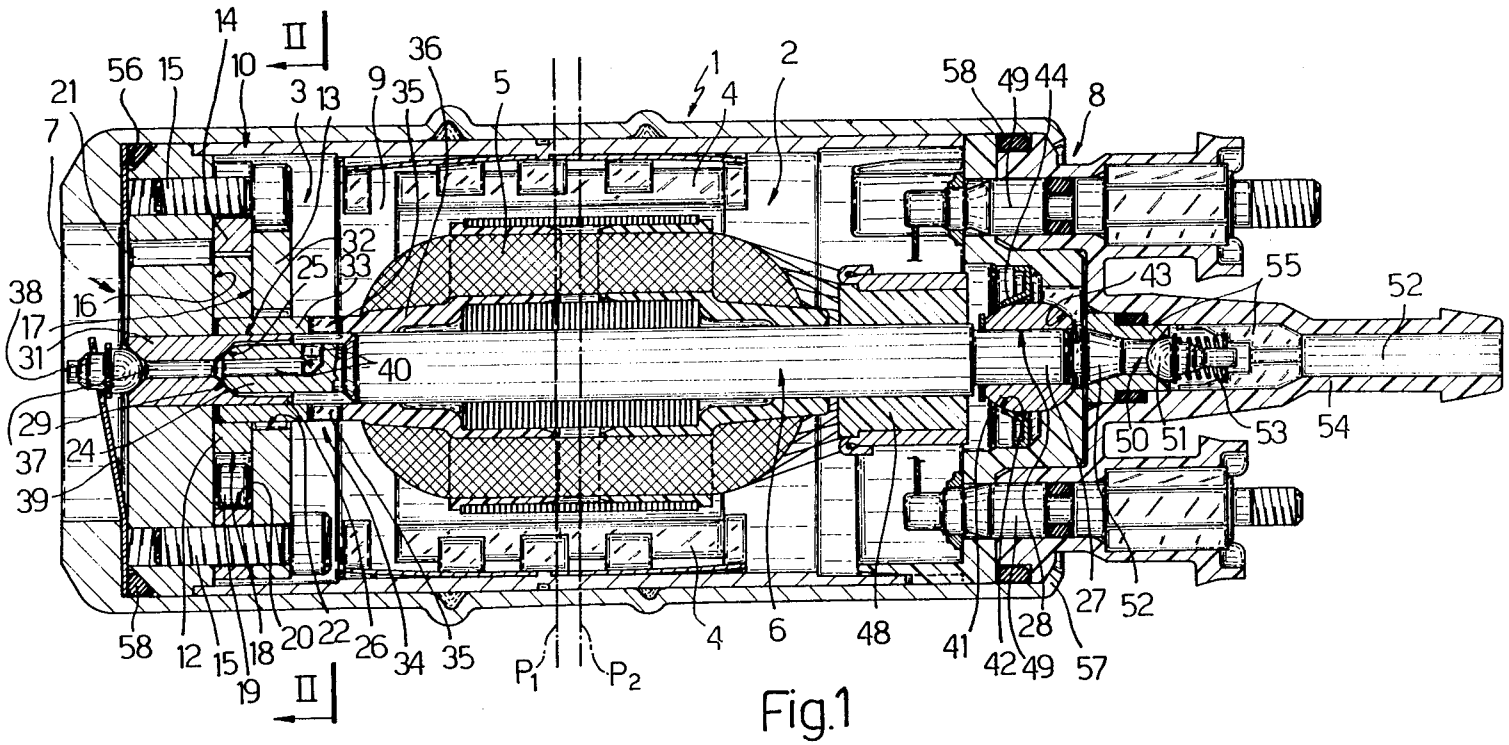
FIG. 1 is a longitudinal section of the pump of the invention.

The electric fuel pump of the invention is particularly adapted to be used in a fuel injection system intended to supply an internal combustion engine and therefore to supply this fuel to the cylinder injectors of the engine itself.

It substantially comprises a casing, generally indicated 1, in which is disposed an electric motor 2 and a pump assembly 3 driven by the motor itself. The motor substantially comprises a stator armature 4 and a rotor winding 5 to which is fixed a rotatable shaft 6.

Figure 2:
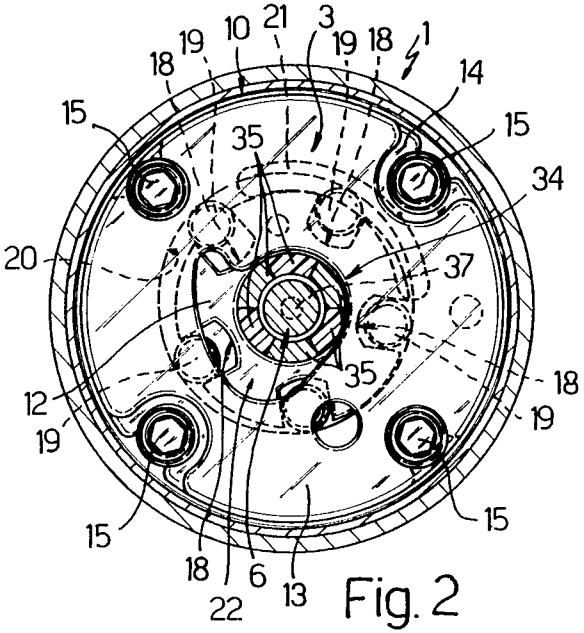
FIG. 2 is a section of the pump of FIG. 1 taken on the line II—II.

The pump further includes a pair of covers 7 and 8 for closing the ends of the casing 1 and defining between them, and within the casing itself, a chamber 9 for the fuel. The actual pump assembly 3 substantially comprises a casing 10 in which an impeller rotor 12 is rotatable driven by the electric motor 2; the casing 10 is substantially constituted by the cover 7, a plate 13 and an annular spacer 14: the said parts are fixed together by means of a series of screws 15. The end cover 7 has a substantially flat inner surface 16 orthogonal to the longitudinal axis of the pump, which is substantially parallel to a corresponding surface 17 of the plate 13; between the said surfaces is disposed the impeller rotor 12, which has a substantially annular form and is provided with a plurality of radial cavities 18 (FIG. 2) within each of which is disposed a corresponding roller 19. The said rollers can cooperate with the inner surface 20 of the spacer 14; as is clearly seen in FIG. 2 the form and disposition of the cavities 18, the rollers 19 and the surface 20 are chosen in such a way as to define, between the impeller rotor and the spacer, a cavity of suitable shape for causing, in a known way, during the rotation of the impeller rotor, an induction of the fuel through a slot 21 formed in the cover 7 and delivery of the fuel itself through a perforation 22 formed in the plate 13.

The end 24 of the shaft 6 (FIG. 1) which is nearest the cover 7 is supported by a seat 25 formed within a cavity of a sleeve 26, which is fixed to the cover 7 and projects axially from the inner surface 16 of the cover itself, whilst the other end 27 of this shaft is supported in a second seat 28 formed on the other cover 8.

Figure 3:
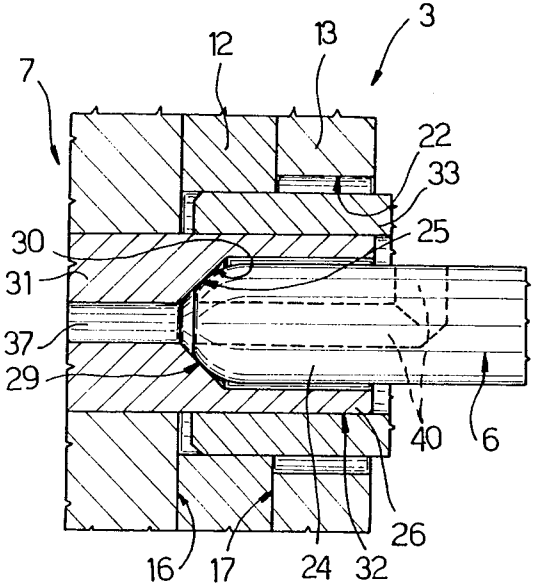
FIG. 3 is a detail on an enlarged scale of the section of FIG. 1.

The first end 24 of the shaft 6 has a spherical surface portion 29 (FIG. 3) and the first seat 25 conveniently has a conical surface portion 30 able to constitute a support for the other surface portion. Moreover, the sleeve 26 is formed on a pin 31 which is fitted within the interior of a corresponding hole in the cover 7.

The sleeve therefore has an outer cylindrical surface 32 which can constitute a bearing for the rotation of the impeller rotor 12. Conveniently this is provided with a second sleeve 33 coaxial with the sleeve 26 and which projects axially from the impeller rotor itself towards the electric motor 2; this sleeve is borne on the outer surface 32 and is conveniently fitted into a hole in the impeller rotor 12.

Clutch means 34 are disposed between the impeller rotor and the rotor winding for the purpose of driving the impeller rotor into rotation; these clutch means can be conveniently constituted by a series of frontal teeth 35 formed on one end of the sleeve 33 and able to engage in corresponding cavities formed on a core 36 of tubular form on which the rotor winding is formed. As is clearly seen from FIG. 1 the axial length of the sleeve 33 is chosen in such a way that the frontal teeth 35 formed on it are located substantially in a plane orthogonal to the axis of the pump, the distance of which from the rotor winding 6 is less than the distance therefrom of the plane in which lies the end surface of the sleeve 26 which is fitted into the cover 7.

Conveniently the inner cover of the sleeve 26 in which the end 24 of the shaft 6 is lodged is in communication with an axial hole 37 which traverses the cover 7 and the path through which is controlled by an interception member 38 normally held closed by a spring 39. The said end of the shaft is moreover provided with holes 40 operable to put the hole 37 into communication with the chamber 9 of the pump in such a way that the interception member 38 and the parts associated with it constitute an excess pressure valve for the fuel contained in the chamber.

The mid planes, orthogonal to the axis of the pump, of the stator armature 4 and the rotor winding 5 respectively, the lines of which have been indicated with the reference numerals P1 and P2 in Figure 1, are spaced from one another in such a way as to generate an axial electromagnetic force on the rotor winding 5 tending to hold the spherical surface portion 29 of the end 24 of the shaft 6 against the corresponding conical surface 30 of the seat 25.

In the embodiment of FIG. 1 the second seat 28 is formed on a bush 41 which is externally delimited by a spherical surface portion 42 which can engage with a corresponding spherical surface of the cover 8; a part of this, indicated 43, is formed on the cover, and another part of the same surface is formed by means of a ring 44 fixed to the cover itself in any suitable manner.

Figure 5:
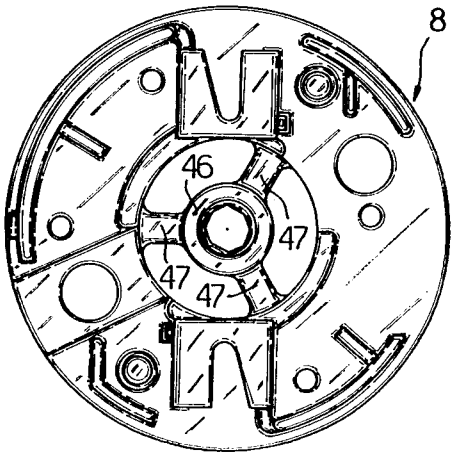
FIG. 5 is a side view of an end cover of the pump in conformity with the embodiment of FIG. 4.
Figure 6:
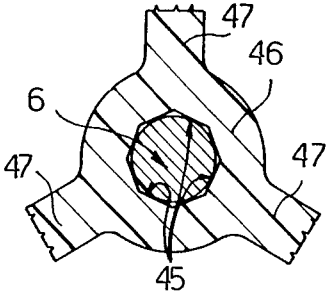
FIG. 6 is a section taken on the line IV—IV of the central part of the end cover of the pump.
Figure 4:
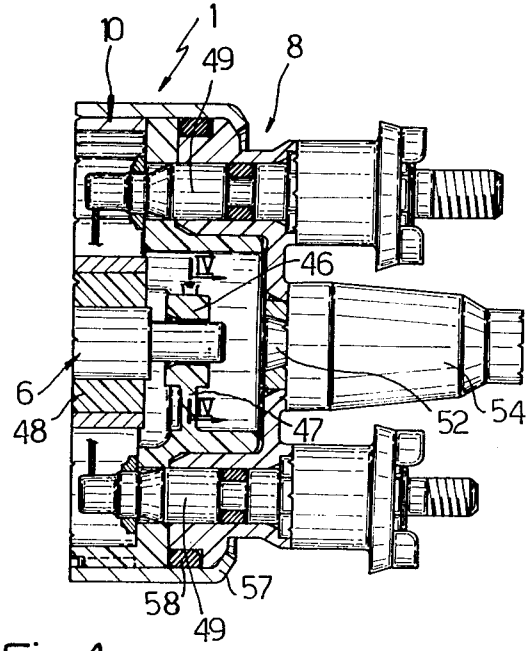
FIG. 4 is a section of the end part of the pump of the invention corresponding to a second embodiment thereof.

In the embodiment of FIGS. 4, 5 and 6 the second seat 28 is prismatic as can be seen in the section of FIG. 6, comprising a plurality of flat surfaces 45; this seat is conveniently formed on a small bush 46 (FIG. 4) connected to the cover by means of a plurality of spokes 47.

The pump of the invention further includes a manifold 48 also supported by the rotatable shaft 6 and on which bear suitable brushes (not shown) to which current is supplied through suitable rheophores 49 fixed, in any suitable manner, in suitable holes in the cover 8 as is clearly seen in FIG. 1.

The pump of the invention is further provided with a non-return valve 50 substantially comprising an interception member 51 thrust against a corresponding seat of a discharge duct 52 by a coil spring 53. The duct 52 is formed internally with a connector 54 projecting axially towards the exterior of the cover 8; a part of the duct itself is formed internally by a pair of bushes 55 as can be clearly seen in FIG. 1.

The casing 1 bears on the outer surface of the stator armature 4 and the ends of this latter bear against the end covers 7 and 8. The casing thus has a front shoulder 56 against which the cover 7 bears whilst the rear edge 57 of it is plastically deformed onto the cover 8; sealing rings 58 are disposed between the covers and the casing.

The operation of the pump described is as follows.

During rotation of the rotor winding 5 the impeller rotor 12 is driven to rotate by the clutch means 34 and therefore fluid is drawn in through the slot 21 to be supplied under pressure, through the perforation 22, into the interior of the chamber 9; from this the fluid flows out to the user through the discharge duct 52. The fluid under pressure within the chamber 9 also fills the holes 37 and 40 formed, respectively, in the pin 31 and in the end 24 of the shaft 6: in this way, whenever the pressure of the fluid is greater than a predetermined value depending on the pre-load on the spring 39, the interception member 38 becomes spaced from the associated seat to allow the fluid to flow back towards the supply.

During periods of inactivity of the pump the duct which is located downstream of the connector 54 is not emptied of fuel because of the presence of the non-return valve 50 which, in the absence of pressure, closes the discharge duct 52.

The spherical surface portion 29 (FIG. 3) is constantly held in contact with the corresponding conical surface 30, both when the electric motor 2 is not energised and during rotation thereof because of the electromagnet force which the stator armature 4 applies to the rotor winding 5 and which tends to make this latter displace towards the left of FIG. 1: this is achieved by the fact that the two first-defined mid planes P1 and P2 are not coincident but spaced from one another by a predetermined amount. In this way the axial position of the rotatable shaft 6, and therefore of the rotor winding 5 fixed to it, is rigorously defined with respect to the other parts of the pump and in particular with respect to the impeller rotor 12; moreover this coupling condition between the first-defined surface portions is preserved whatever the wear condition of the surfaces themselves, in this way avoiding the formation of unwanted axial play.

The coupling between the spherical surface portions 29 and the conical surface portions 30 moreover forms a bearing of mixed type able to support both radial loads and axial loads and therefore not only the radial loads which act on the end 24 of the shaft, but also the axial loads which are generated by the first-mentioned electromagnet force can be supported by this coupling. This coupling further constitutes a bearing of oscillating type and therefore the coupling is correct to support both radial loads and axial loads even if the axis of the shaft 6 forms a small angle with respect to the longitudinal axis of the pump, and in particular with respect to the sleeve 26. Consequently therefore small errors in assembly and in working can be compensated, or the various parts of the pump, and in particular the end cover 8, can be made with wider tolerances; in fact, even if the rotatable shaft 6 is mounted with its axis forming a small angle with the longitudinal axis of the pump, correct operation thereof is still achieved.

Whenever the constructional arrangement of FIG. 1 is adopted, that is to say when the second end 27 of the shaft 6 is supported by means of the bush 41, there is a perfectly isostatic disposition of the shaft 6, in which rotation of both ends of the shaft itself are allowed and therefore significant errors in assembly can be compensated or wide manufacturing tolerances can be employed: in fact, in the embodiment of FIG. 1, the end 27 of the shaft 6 can also be rotatable with respect to the cover 8 because of the possibility that the bush 41 may rotate in the associated seat of the cover and because of the axial freedom which the end 27 has with respect to the bearing seat 28 in the bush itself.

In the pump of the invention the volumetric efficiency of the pump 3 itself is very high because of the perfect parallelism between the surfaces which externally delimit the impeller rotor 12 and the surfaces 16 and 17 of the cover 7 and the plate 3 respectively, with which the first surfaces are coupled. In fact, the axis of the impeller rotor 12 is coincident with the axes of the cover and the said plate, the first being centred on the sleeve 26, which is in turn perfectly coaxial with the cover 7 because of the fixing achieved by means of the pin 31; the sleeve 26, being very short, can be mounted on the cover 7 with its axis rigorously perpendicular to that of the surface 16 of the cover itself, and perfectly coaxial therewith. Consequently, therefore, losses by escape of liquid between the coupled surfaces of the impeller rotor 12 and the cover 7 and of the plate 13 are extremely modest.

Moreover, the structure of the pump is very simple: in particular, the structure of the rotor winding 5; this, in fact, not being rotatable with respect to a fixed shaft of the pump, has no bearings to support it for rotation with respect to this shaft, nor an internal sleeve for housing these bearings.

This rotor winding can be balanced in a very rigorous manner before being assembled on the pump: for this purpose the assembly constituted by the rotor winding and the shaft 6 on which it is mounted can be directly mounted on a balancing machine by engaging the ends 24 and 27 of the shaft itself onto suitable seats with which the machine itself is provided.

The various units of which the pump is constituted and which are prepared before assembly have a simple structure and very small dimensions thereby facilitating considerably their storage, transfer and inspection; in particular, as opposed to other pumps of previously known type, there is no unit comprising a cover and a fixed shaft secured to it having very large longitudinal and transverse dimensions.

It is evident that the various parts of the structure of the pump which has been described can have modifications and variations introduced thereto without by this departing from the ambit of the invention.

We claim:

1. An electric fuel pump comprising a casing in which is disposed a stator armature of an electric motor, a rotatable shaft to which a rotor winding of the said electric motor is fixed and which is connected torsionally to an impeller rotor of the pump, and first and second covers for closing ends of the said casing and defining between said ends a fuel chamber within the casing, the said impeller rotor bearing substantially against an internal surface of said first cover and adapted to cause the fuel to flow axially within the said chamber, characterized by the fact that a first end of the said rotatable shaft has a spherical surface portion and, a sleeve secured to the said first cover and projecting axially from the internal surface of said first cover, said sleeve including a cavity, said cavity including a conical surface portion for supporting said spherical surface portion of said shaft whereby said conical surface portion constitutes a bearing for said spherical surface portion, and a second end of the said fixed shaft being supported by a second seat formed in said second cover.

2. A pump according to claim 1, characterised by the fact that the said sleeve has a cylindrical outer surface able to constitute a bearing for the rotation of the said impeller rotor of the pump.

3. A pump according to claim 1, characterised by the fact that the said cavity of the said sleeve is in communication with an axial hole which passes through the said first cover and flow through which is controlled by an interception member normally held closed by a spring, the said first end of the said rotatable shaft being provided with holes able to put the said cavity of the sleeve into hydraulic communication with the said pump chamber in such a way that the said interception member and parts associated with it constitute a pressure relief valve for the fuel contained in the said chamber.

4. A pump according to claim 1, characterised by the fact that the said sleeve is formed on a pin fitted in an axial hole of the said first cover.

5. A pump according to claim 1, characterised by the fact that the said impeller rotor of the pump is provided with a second sleeve coaxial therewith and projecting axially therefrom, an internal surface of an second sleeve bearing on the said outer surface of the said sleeve fixed to the said first cover and the said second sleeve being provided with frontal teeth operable to engage with corresponding frontal teeth formed on a collar of the said rotor winding in such a way that said rotor winding drives the said impeller rotor to rotate.

6. A pump according to claim 5, characterised by the fact that the said second sleeve is fitted in a hole in the said impeller rotor of the pump and its axial length is chosen in such a way that the said frontal teeth formed thereon are located substantially in a plane orthogonal to the axis of the pump the distance of which from the said rotor winding is less than the distance from there to the plane in which the end surface of the said sleeve fixed to the said first cover is located.

7. A pump according to claim 1, characterised by the fact that the said mid plane of the stator armature which is orthogonal to the axis of the pump and that of the said rotor winding are spaced from one another in such a way as to generate an axial electromagnetic force on the said rotor winding tending to hold the said spherical surface portion of the first end of the said rotatable shaft against the corresponding conical surface portion of the said first seat.

8. A pump according to claim 1, characterised by the fact that the said second seat formed on the said second cover is formed on a bush which is externally delimited by a spherical surface portion which can engage with a corresponding spherical surface portion of the second cover.

9. A pump according to claim 1, characterised by the fact that the said seat formed on the said second cover includes a prismatic surface able to support the said second end of the rotatable shaft.

10. A pump according to claim 1, characterised by the fact that the said first cover has fixed thereto a plate and an annular spacer operable to define a second casing for the said pump impeller rotor, the said first and second covers bearing against the said stator armature and the said second casing axially securing the said covers against the said stator armature.

* * * * *

UNITED STATES PATENT AND TRADEMARK OFFICE

CERTIFICATE OF CORRECTION

PATENT NO. : 4,834,623

DATED : May 30, 1989

INVENTOR(S) : Innocenzo Triolo

It is certified that error appears in the above-identified patent and that said Letters Patent is hereby corrected as shown below:

Claim 5, Col. 7, line 34, change "an", second occurrence, to --the said--;

Claim 5, Col. 7, line 35, change "the said", first occurrence, to --an--.

Signed and Sealed this

Twentieth Day of February, 1990

*Attest:*

JEFFREY M. SAMUELS

*Attesting Officer* *Acting Commissioner of Patents and Trademarks*